US007789262B2

(12) United States Patent
Niederer et al.

(10) Patent No.: US 7,789,262 B2
(45) Date of Patent: Sep. 7, 2010

(54) TWO-PLY SEALING ELEMENT PUNCHED OUT IN A COVER SHAPE

(75) Inventors: Andreas Niederer, Melk (AT); Lambert Nekula, Hofstetten (AT)

(73) Assignee: TEICH Aktiengesellschaft, Muhlhofen (AT)

( * ) Notice: Subject to any disclaimer, the term of this patent is extended or adjusted under 35 U.S.C. 154(b) by 1425 days.

(21) Appl. No.: 11/037,095

(22) Filed: Jan. 19, 2005

(65) Prior Publication Data

US 2005/0247713 A1 Nov. 10, 2005

(30) Foreign Application Priority Data

Feb. 2, 2004 (AT) ..... A 146/2004

(51) Int. Cl.
*B65D 41/32* (2006.01)
*B65D 41/00* (2006.01)

(52) U.S. Cl. ..... 220/359.3; 220/359.2; 220/359.4; 229/123.1

(58) Field of Classification Search ... 220/359.2–359.4; 229/123.1–123.2
See application file for complete search history.

(56) References Cited

U.S. PATENT DOCUMENTS 3,335,939 A * 8/1967 Robinson, Jr. ..... 229/123.2
4,693,390 A * 9/1987 Hekal ..... 220/270
4,735,335 A * 4/1988 Torterotot ..... 220/270
4,771,937 A * 9/1988 Kamada et al. ..... 229/123.1
4,801,041 A * 1/1989 Takata et al. ..... 220/270
4,848,931 A * 7/1989 Kamada et al. ..... 383/104
4,858,780 A * 8/1989 Odaka et al. ..... 220/269
4,905,838 A * 3/1990 Suzuki et al. ..... 229/123.1
4,913,307 A * 4/1990 Takata et al. ..... 220/276
5,092,469 A * 3/1992 Takata et al. ..... 206/245
5,141,126 A * 8/1992 Takata et al. ..... 220/266
5,160,767 A * 11/1992 Genske et al. ..... 428/35.9
5,167,339 A * 12/1992 Takata et al. ..... 220/270
5,178,293 A * 1/1993 Suzuki et al. ..... 220/359.3

(Continued)

FOREIGN PATENT DOCUMENTS

DE 37 06 962 A1 9/1988

(Continued)

OTHER PUBLICATIONS

European Search Report, dated Sep. 18, 2006.

*Primary Examiner*—Anthony Stashick
*Assistant Examiner*—Ned A Walker
(74) *Attorney, Agent, or Firm*—Young & Thompson

(57) ABSTRACT

An element which is punched out in a cover shape for sealing of containers, includes two plies with at least one opening aid which is integrated within these plies, the ply (3) located in the direction of the container having a plastic layer which is provided with perforations or scoring. The layers of the sealing element are cemented by a peelable adhesive layer, the opening aid and the ply which has the plastic layer being free of adhesive in the area of its perforations or scoring. The sealing element enables not only facilitated sealing of food containers, such as microwave containers, since mutual displacement or slippage of the individual plies due to the adhesive layer is prevented, but that any type of penetration of adhesive into the food container, thus into the food, is prevented in any case by the peelability of the adhesive.

15 Claims, 3 Drawing Sheets

U.S. PATENT DOCUMENTS 5,197,618 A * 3/1993 Goth ..... 215/232
5,213,227 A * 5/1993 Koyama et al. ..... 220/359.3
5,235,149 A * 8/1993 Boehrer ..... 219/734
5,316,603 A * 5/1994 Akazawa et al. ..... 156/69
5,342,684 A * 8/1994 Carespodi ..... 428/347
5,873,483 A * 2/1999 Gortz et al. ..... 220/269
6,033,758 A * 3/2000 Kocher et al. ..... 428/138
6,056,141 A * 5/2000 Navarini et al. ..... 220/269
6,135,304 A * 10/2000 Wyslotsky ..... 220/276
6,248,380 B1 6/2001 Kocher et al.
6,308,853 B1 * 10/2001 Jud ..... 220/359.3
6,790,508 B2 * 9/2004 Razeti ..... 428/138
2004/0013827 A1 * 1/2004 Zuser et al. ..... 428/34.1
2008/0110896 A1 * 5/2008 Westphal ..... 220/359.2

FOREIGN PATENT DOCUMENTS

DE 19523754 A1 * 1/1997
EP 514803 A1 * 11/1992
EP 0 457 629 2/1995
EP 1340694 A2 * 9/2003
WO WO 01/83208 11/2001
WO WO 03/009997 2/2003

* cited by examiner

TWO-PLY SEALING ELEMENT PUNCHED OUT IN A COVER SHAPE

BACKGROUND OF THE INVENTION

This invention relates to an element which is punched out in a cover shape for sealing of containers, consisting of two plies with at least one opening aid which is integrated within these plies, the ply located in the direction of the container having a plastic layer which is provided with perforations or scoring. The invention relates furthermore to a process for producing this two-ply sealing element.

For example, the sealing of microwave containers with two-ply sealing elements is known, the outer ply being a paper or metal layer and the second ply facing the container being a plastic layer. Since the materials of the outer ply oppose the passage of microwaves, they must be removed before heating the container. The container which has now been sealed with the plastic film must then be perforated by hand in order to enable escape of water vapor during heating or cooking of the contents.

DESCRIPTION OF THE RELATED ART

According to European patent no. 457 629, a two-ply sealing element for microwave containers is described which has one metal layer and furthermore one plastic layer which can be reactivated by heat and which is located in the direction of the edges of the container. When the container is sealed by hot sealing, in the area of the seal seam a crosslinking reaction takes place within the thermally reactivatable plastic layer so that by formation of the seal seam an air-tight seal of the container is enabled. This thermally reactivatable plastic layer can furthermore have perforations so that formation of an overpressure in the container during heating or cooking of the contents by microwaves is prevented.

The two-ply sealing elements described according to European patent no. 457 629 are produced by coextrusion of the thermally reactivatable plastic film onto a metal layer as the outer ply in the form of rolled material. This rolled material is used for the packaging process which takes place continuously. Punching-out in the form of individual sealing elements is however not possible since the laminate produced by coextrusion is present in a loose arrangement so that during handling, slippage of the plies takes place.

SUMMARY OF THE INVENTION

The invention is intended to provide a remedy here.

The invention provides a two-ply sealing element characterized in that the plies of the sealing element are cemented by means of a peelable adhesive layer and that the opening aid and the ply which has the plastic layer are free of adhesive in the area of the perforations or scoring.

The invention relates furthermore to a process for producing the sealing element, in the first process step the plies of the sealing element being produced in the form of a prelaminate and on the ply which has the plastic layer perforations or scoring being made, that then by cold lamination the plies of the sealing element are cemented to one another, but the area of the perforations or scoring on the ply which has the plastic layer and the area of the opening aid remaining free of adhesive.

Other embodiments of the process are disclosed.

BRIEF DESCRIPTION OF THE DRAWINGS

The invention is detailed below using one possible embodiment of the invention and using one possible process version for producing the inventive sealing element.

These possible embodiments are shown in the accompanying drawings, comprising.

DESCRIPTION OF THE PREFERRED EMBODIMENTS

Figure 1A:
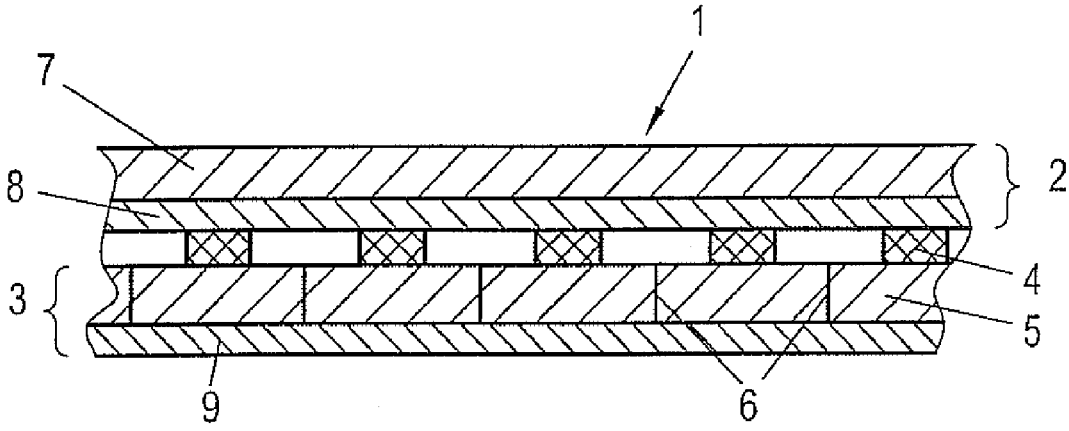
FIG. 1*a* showing one possible embodiment of the two-ply sealing element.

In the production of the sealing element 1 of the invention the individual plies 2 and 3 are produced in the form of a prelaminate.

For producing the ply 2 which faces away from the container, for example aluminum foil with a thickness in the range from 10 to 100 mm is used. It is however also possible to use plastic films in the thickness range from 10 to 100 mm. The plastics can be selected from the group polypropylene, polyethylene, polyester, polyacrylate, polyamide, or polystyrene.

This metal foil or plastic film 7 can now be provided with typography on its surface side facing the viewer. This can be both smooth and also rough in its surface configuration. The surface roughness yields the desired typography by the irregular, but also regular arrangement of the print motifs. Furthermore the surface roughness facilitates the unstacking of the sealing elements which are conventionally stored on top of one another in magazines.

On the side opposite the typography the film 7 is provided exclusively with a heat-sealable layer 8. The latter can be present as a hot sealing wax, coextrusion coating or peelable plastic film.

In a further process step the ply 3 which faces the container is produced. Here a plastic film 5, for example a polypropylene film with a thickness from 10 to 100 mm, is coated with a heat-sealable layer 9. This coating can likewise be present as a hot sealing wax, coextrusion coating or peelable plastic film, its seal seam strength, dictated by the choice, chemical components and degree of crosslinking of the components having to be higher than those of the layer 8. This is therefore the case since the seal seam strength produced by the layer 9 is designed to ensure the air-tight sealing of the packaging or of the container, conversely the seal seam strength produced by the layer 8 causes the joining of the plies 2 and 3, but at the same time is designed to enable the "peeling process", i.e. detachment of the plies from one another.

After lamination with the heat-sealable layer 9, on the surface of the plastic film 5 perforations or scoring 6 are made. Slightly slitting the surface of the plastic film for example yields slotted perforations, needles conversely yield point scoring.

Figure 1B:
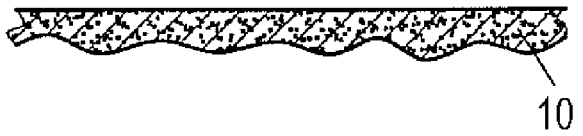
FIGS. 1*b* and 1*c* showing alternative embodiments thereof.
Figure 1C:
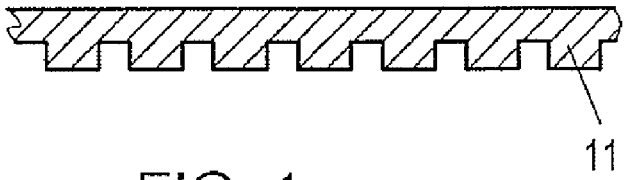

In order to facilitate the storage of the finished sealing element 1 of the invention, which conventionally takes place in a stack, the heat-sealable layer 9 which is laminated on the plastic film 5 is advantageously applied in the form of an imprint 10 with a rough surface. This takes place, as is shown in FIG. 1*b*, for example by adding additives, such as silicon particles. The surface roughness which has been produced greatly facilitates the unstacking process when using the sealing elements 1 of the invention. This is therefore the case since between the superficially attached "deformations" air is enclosed and therefore the individual sealing elements during unstacking can be more easily removed from one another. This process can be additionally improved in that as shown in FIG. 1*c* there is a superficially rough imprint of the heat-sealable layer 9 in the form of spacers 11. These spacers, due to their geometrical arrangement, enclose air in the likewise regularly arranged intermediate spaces so that the unstacking process is additionally facilitated. This is especially necessary when the containers must be quickly sealed during packaging, as in the case of foods.

Furthermore it is possible to apply the imprint which has been applied to the ply 2 facing away from the container in the aforementioned superficially rough configuration, so that this measure in addition or alone causes or additionally supports the unstacking capacity.

Figure 2:
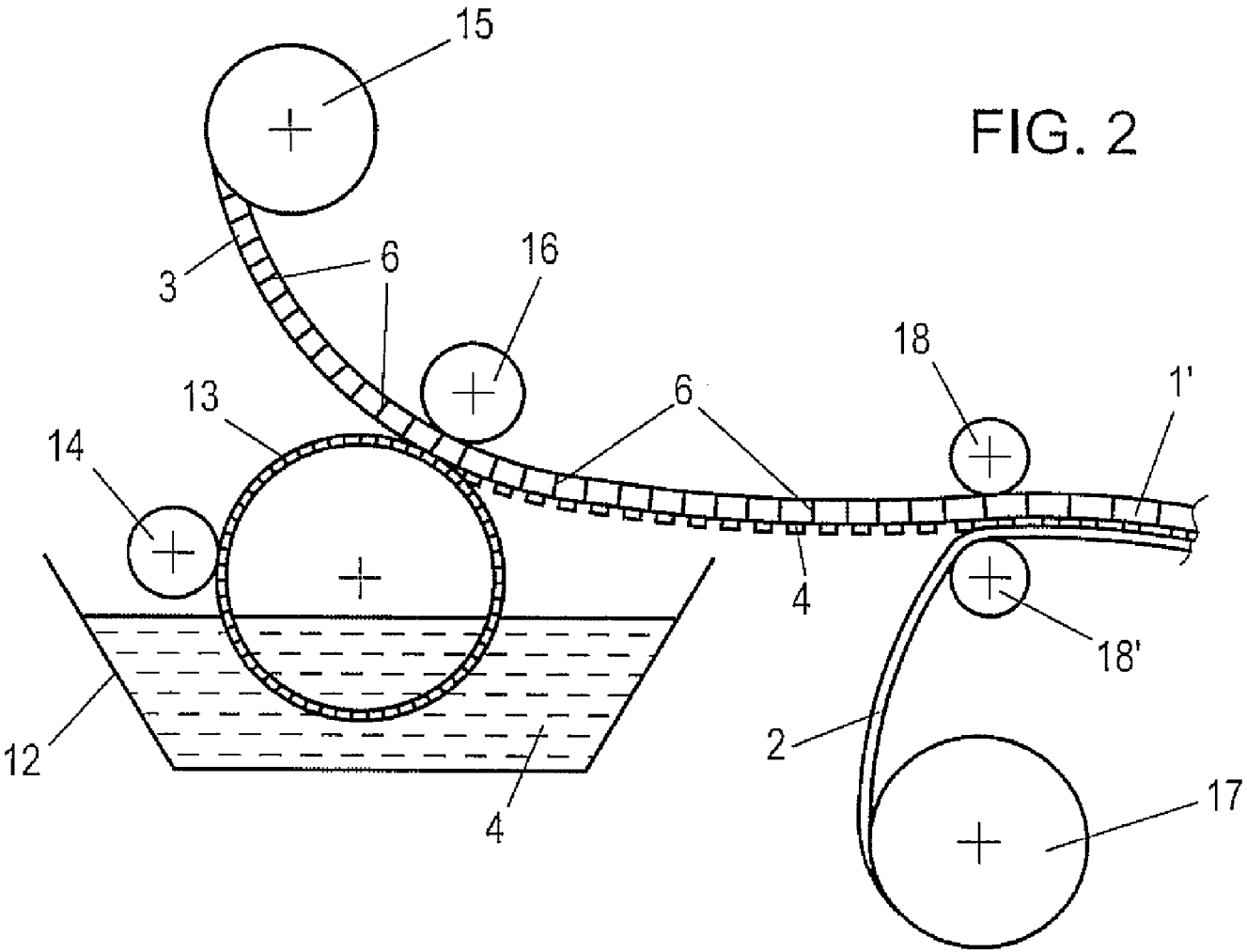
FIG. 2 showing possible process management for producing the sealing element of the invention, and FIG. 3 showing a container which is sealed with a sealing element of the invention.

The plies 2 and 3 of the sealing element of the invention which are present as a prelaminate are now cemented to one another in a cold lamination process, as is shown in FIG. 2. In doing so, in a storage container 12 the adhesive 4, for example a polyurethane cement, is scooped out of the container by means of an applicator roll 13, and at the same time using a calibrating roll 14 the application volume can be controlled. Likewise, instead of polyurethane an acrylic acid ester copolymer-containing dispersion can be used. This dispersion which is available under the name Flexbond® is free of softener and therefore is especially well suited to packaging of food. At this point the prelaminate in the form of a ply 3 containing the plastic layer is pulled off a storage roll 15 and brought to the surface of the applicator roll 13 via a deflection roll 16. Due to the given surface structure of the applicator roll 13 and the triggered feed of the prelaminate 3 with the aid of control elements, exact adhesive application takes place so that the perforations or scoring 6 remain free of adhesive in the ply 3 which has the plastic layer.

At this point the ply 2 containing the metal layer is pulled off the storage roll 17 and by means of pressure rolls 18, 18' is pressed with the ply which has the plastic layer and already the adhesive 4. The areas for the opening aid 20 are arranged such that they remain free of adhesive in the same way as the perforations or scoring 6. The plies 2 and 3 are cemented to one another by this cold lamination process so that the sealing element 1' is produced. Due to the type of adhesive 4, for example a polyurethane adhesive, and the selected cold lamination process, an adhesive bond between the individual layers 2 and 3 of the sealing element 1 is ensured and remains unchanged even during the subsequent sealing process during packaging, i.e. when the containers are being sealed. This makes it possible to produce the desired sealing element 1 in a simple manner from the web 1'—as sketched in FIG. 2—by punching without the individual layers 2, 3 being changed in their positioning. During punching the opening aid which is likewise present free of adhesive, such as a pull tab 20, 20', is formed.

Figure 3:
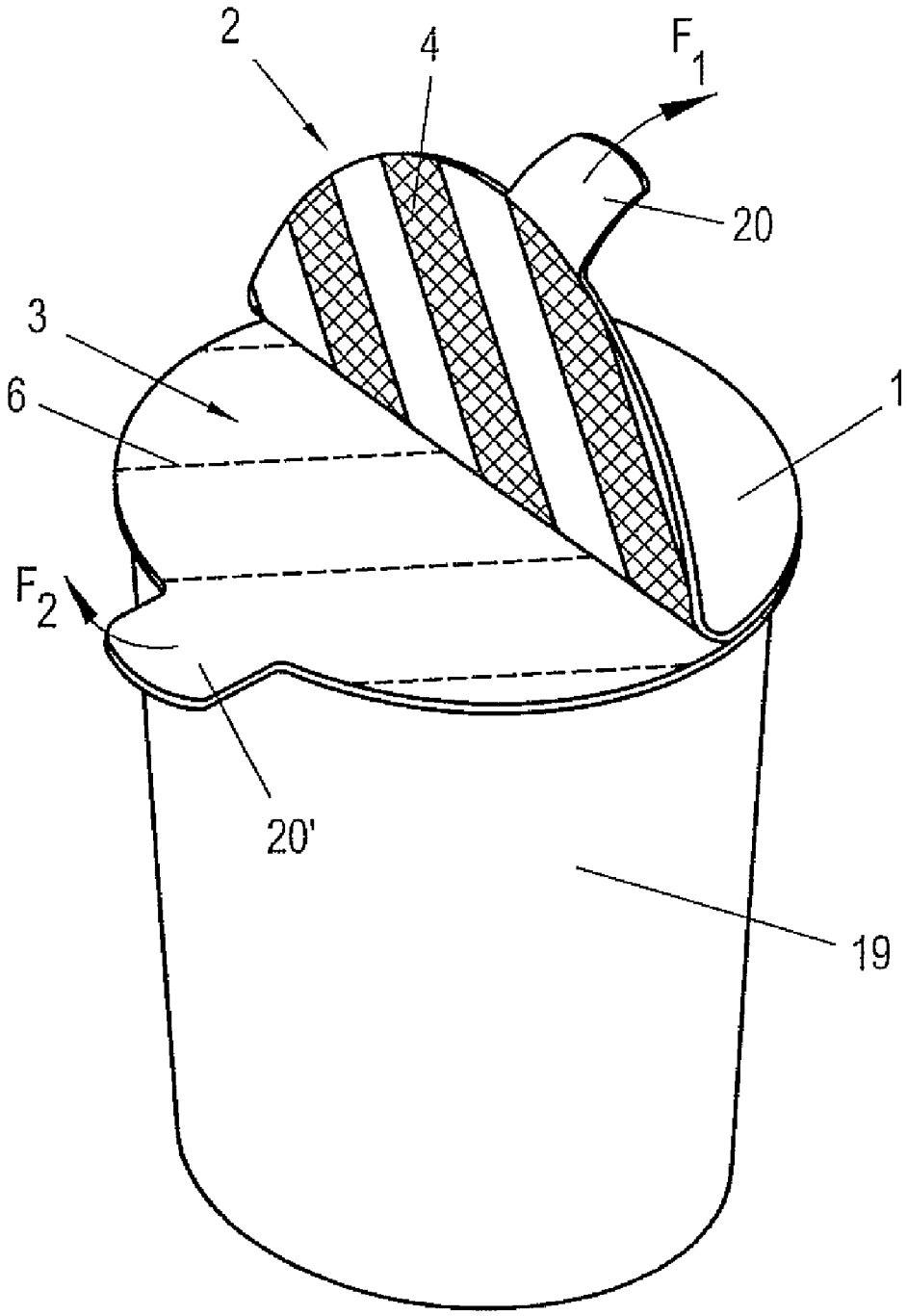

The sealing elements 1 of the invention are stored in stacks after punching and can be delivered to further use, specifically the sealing of food containers. In doing so for example microwave containers 19 which are already filled with food are continuously covered with the sealing element of the invention and are sealed airtight by means of sealing tools. Before heating in a microwave oven, as is shown in FIG. 3, the ply 2 which contains for example a metal layer is grabbed by the pull tab 20 and is pulled off from the ply 3 which has the plastic layer in the direction of the arrows with a tearing force $F_1$. By this peeling process now the scoring or perforations 6 on the plastic layer are exposed, conversely the adhesive, as is shown in FIG. 3, remains adherent in the form of a strip-shaped pattern on the ply 2 which contains for example the metal layer. In this way it is also ensured that any type of penetration of adhesive through the scoring or perforations of the plastic layer is prevented, since it is heated in the microwave oven only after complete removal of the ply 2 which contains the metal layer. After heating, the ply 3 which has the plastic layer can be removed from the container 19 by pulling on the pull tab 20' in the direction of the arrow $F_2$ so that the removal of the packaging material is enabled.

In summary it can therefore be stated that the sealing element 1 of the invention enables not only facilitated sealing of food containers, such as microwave containers, since mutual displacement or slippage of the individual plies due to the adhesive layer is prevented, but that any type of penetration of adhesive into the food container, thus into the food, is prevented in any case by the peelability of the adhesive.

The invention claimed is:

1. A combined container and cover element (1) for sealing of the container (19), the combined container and cover element comprising:

a container having a top end;

a cover sealed to the top end of the container, wherein the cover comprises:

a first ply (3) comprising a plastic layer (5) having an upper surface and a lower surface;

a second ply (2);

a peelable adhesive layer (4) removably adhering the upper surface of the plastic layer of the first ply to the second ply, the peelable adhesive layer providing a seal seam strength produced between the first and second plies;

at least one opening aid (20) integrated within an adhesive-free area of the first and second plies; and one of perforations and scoring (6) provided in the plastic layer of the first ply (3);

wherein the first ply is a bottom layer closest to the container and the lower surface of the plastic layer is provided with a hot-sealable layer for sealing to the top end of the container, the hot-sealable layer having a seal seam strength which is greater than the seal seam strength provided by the peelable adhesive layer, and wherein adhesive does not contact the one of the perforations and the scoring on a side of the first layer farthest from the container such that the upper surface of the plastic layer of the first ply (3) is free of adhesive in areas above and immediately surrounding the one of the perforations and the scoring (6).

2. The element of claim 1, wherein the adhesive layer (4) comprises polyurethane cement.

3. The element of claim 1, wherein the first and second plies (2, 3) comprise single or compound materials.

4. The element of claim 1, wherein the second ply (2) is furthest from the container and comprises a metal foil.

5. The element of claim 1, wherein the plastic layer (5) comprises plastics selected from the group consisting of polypropylene, polyethylene, polyester, polyacrylate, polyamide, polystyrene and copolymers formed therefrom.

6. The element of claim 1, wherein the second ply (2) is furthest from the container and on a surface side facing the peelable adhesive layer is provided with a hot-sealable layer (8).

7. The element of claim 1, wherein the second ply (2) is furthest from the container and on a side facing away from the peelable adhesive layer has typography.

8. The element of claim 1, wherein the second ply (2) comprises an aluminum foil.

9. The element of claim 1, wherein the second ply (2) is furthest from the container and on a side farthest from the peelable adhesive layer has typography with a superficially rough configuration.

10. The element of claim 1, wherein the hot-sealable layer (9) has a rough surface.

11. The element of claim 10, wherein the hot-sealable layer (9) is present in the form of geometrically arranged spacers (11).

12. The element of claim 1, wherein the opening aid (20) has the form of a pull tab.

13. The element of claim 12, wherein the pull tab (20, 20') is present in both the first and second plies.

14. An element (1) sealing a container (19), comprising:

a first ply (3) comprising a plastic layer (5), the plastic layer comprising one of perforations and scoring and having an upper surface and a lower surface, the upper surface of the first ply being free of any adhesive at the one of the perforations and the scoring;

a second ply (2) with an upper surface and a lower surface;

a peelable adhesive layer (4) comprising an adhesive removably adhering the upper surface of the plastic layer of the first ply to the lower surface of the second ply, the peelable adhesive layer providing a seal seam strength produced between the first and second plies;

the adhesive layer comprising plural adhesive areas and plural adhesive-free areas, the adhesive areas of the adhesive layer contacting the upper surface of the plastic layer of the first ply in areas other than at the one of the perforations and the scoring and the adhesive layer not contacting the upper surface of the plastic layer of the first ply in areas of the one of the perforations and the scoring; and an opening aid (20) integrated within an adhesive-free area of the first and second plies, wherein the upper surface of the first ply (3) is free of the adhesive in the areas of the one of the perforations and the scoring (6); and a container (19), wherein, the first layer is a bottom layer closest to the container, and the first layer is attached to the container.

15. The element (1) sealing the container (19) of claim 14, wherein, the second ply (2) is furthest from the container and comprises a metal foil, the plastic layer (5) comprises plastics selected from the group consisting of polypropylene, polyethylene, polyester, polyacrylate, polyamide, polystyrene and copolymers formed therefrom, the second ply (2), on a surface side facing the peelable adhesive layer, comprises a hot-sealable layer (8), the plastic layer (5), on a side closest to the container, comprises a hot-sealable layer (9) with a seal seam strength greater than a seal seam strength between the first and second plies, and the opening aid (20) has the form of a pull tab and is present in both the first and second plies.

* * * * *